US006644390B2

(12) United States Patent
Baumgartner et al.

(10) Patent No.: US 6,644,390 B2
(45) Date of Patent: Nov. 11, 2003

(54) METHODS AND APPARATUS FOR PREVENTING THE INADVERTENT, UNCONTROLLED DISCHARGE OF PRESSURIZED RADIATOR FLUID

(75) Inventors: Werner K. Baumgartner, Harrison Township, MI (US); Guy E. La Falce, Sterling Hts, MI (US); Kulwinder Singh, Lake Orion, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/155,245

(22) Filed: May 24, 2002

(65) Prior Publication Data

US 2002/0174974 A1 Nov. 28, 2002

Related U.S. Application Data

(63) Continuation-in-part of application No. 09/567,415, filed on May 9, 2000, now abandoned.

(51) Int. Cl.[7] ..... B65D 53/04
(52) U.S. Cl. ..... 165/148; 220/203.06
(58) Field of Search ..... 165/71, 148; 220/203.06

(56) References Cited

U.S. PATENT DOCUMENTS 4,320,844 A * 3/1982 Cooper ..... 215/260
4,353,475 A * 10/1982 Kachur et al. ..... 215/223
4,553,678 A * 11/1985 Thorsbakken ..... 215/218
5,071,020 A * 12/1991 Reutter ..... 220/203

FOREIGN PATENT DOCUMENTS

DE 3232178 A1 * 3/1984 ..... B65D/53/04
WO WO-98/31598 A1 * 7/1998

* cited by examiner

*Primary Examiner*—Allen Flanigan
(74) *Attorney, Agent, or Firm*—Cary W. Brooks

(57) ABSTRACT

A radiator includes a neck including a pair of openings and a plurality of threads configured to engage a plurality of threads disposed within a radiator cap. The neck threads and the radiator cap threads each include a thread stop and a clearance and permit the radiator cap to rotate to a fully closed position. The clearance permits the radiator cap to move in an axial direction when not in the fully closed position without rotating from the fully closed position. The thread stops are configured prevent the radiator cap from rotating after moving axially.

9 Claims, 5 Drawing Sheets

METHODS AND APPARATUS FOR PREVENTING THE INADVERTENT, UNCONTROLLED DISCHARGE OF PRESSURIZED RADIATOR FLUID

This is a continuation-in-part of U.S. Ser. No. 09/567,415 filed on May 9, 2000 now abandoned.

BACKGROUND OF THE INVENTION

This invention relates generally to radiators and, more particularly, to radiators for preventing inadvertent, uncontrolled discharges of pressurized radiator fluids.

Automobile radiators and surge tank radiators are well known to those skilled in the art. An operating automobile motor uses a radiator to withdraw heat from the motor. While the motor cools, the radiator develops a substantial amount of pressure buildup and hot liquid under pressure. Such radiators often require a user to remove a radiator cap to inspect the radiator and add additional fluid to the radiator.

Known surge tank radiator caps include a sealing system which permits fluid pressures to vent through a discharge while the radiator cap remains installed and sealed to the radiator. However, surge tank radiator caps may be rotated and removed from the radiator, regardless of the pressure contained within the radiator.

SUMMARY OF THE INVENTION

In an exemplary embodiment, a radiator includes a body which holds fluid and a neck extends from the body and forms a first opening. The neck includes a second opening and a plurality of threads. A radiator cap also includes a plurality of threads configured to engage the neck threads. The neck threads and the radiator cap threads are configured to permit the cap to rotate to a fully closed position. The neck threads include a clearance and a thread stop configured to contact a mating thread stop disposed on the radiator cap threads. The clearance permits the radiator cap to move in an axial direction without rotating when the cap is not in the fully closed position.

In operation of one embodiment, as the radiator is pressurized, the radiator fluid within the radiator is pressurized. The radiator cap includes a pair of "O" rings configured to permit the radiator to safely vent the excess pressure through the second opening in the neck to a recovery tank without the radiator cap being removed. If a user attempts to remove the cap when the radiator is pressurized, the radiator cap moves axially from the radiator, the neck thread stop contacts the radiator cap thread stop to prevent the radiator cap from rotating, and the pressure is relieved between the first and second o-rings. After the pressure within the radiator decreases, the radiator cap moves axially towards the neck and can be rotated and fully removed.

DESCRIPTION OF THE PREFERRED EMBODIMENT

Figure 1:
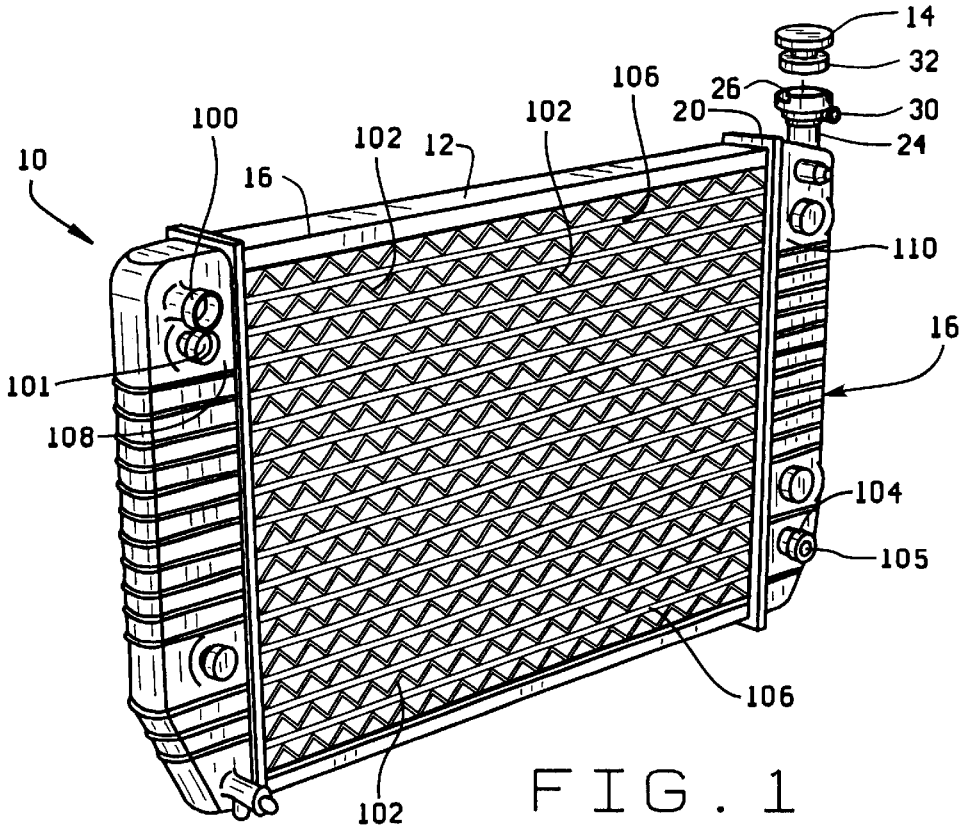
FIG. 1 is an exploded perspective view of a radiator assembly.

FIG. 1 is an exploded perspective view of a radiator assembly 10 including a radiator 12 and a radiator cap 14. Radiator 12 is generally rectangular in shape and includes a body 16. Body 16 holds radiator fluid and includes a top surface 20. A neck 24 extends from body 16 and forms an opening 26 which is used to fill radiator 12 with a coolant fluid (not shown). Neck 24 includes a second opening 30 which is formed from a discharge tube (not shown in FIG. 1). In one embodiment, opening 30 is an overflow opening connected to a surge tank (not shown). Opening 26 is sized to receive a radiator cap extension 32 which extends from radiator cap 14.

The coolant fluid is used to cool a combustion engine or other heat-generating device (not shown). Heat is transferred from the combustion engine or heat-generating device to the coolant fluid, causing the fluid to increase in temperature and pressure. The high temperature, high pressure fluid is then routed to an inlet spout 100 extending from a first header 108 of the radiator 12 and having an inlet opening 101 through which the fluid enters the radiator 12. The fluid circulates through the body 16 generally from the first header 108 through tubes 106 to a second header 110. Heat transfer fins 102 extend outward from the body 16, for example, from the tubes 106. The fins 102 dissipate heat to the atmosphere from the body 16, the body 16 being heated as the fluid travels through the radiator 12 by way of tubes 106. The fluid exits the radiator 12 through a discharge opening 105 of a discharge spout 104 at a reduced temperature and is routed back to the combustion engine or heat-generating device. The discharge spout 104 may extend from the second header 110 of the radiator 12.

Radiator cap 14 is sized to fit over opening 26 and includes a plurality of threads (not shown in FIG. 1). Neck 24 includes a plurality of threads (not shown in FIG. 1) which engage the radiator cap threads and permit radiator cap 14 to rotate fully closed and seal opening 26.

Figure 2:
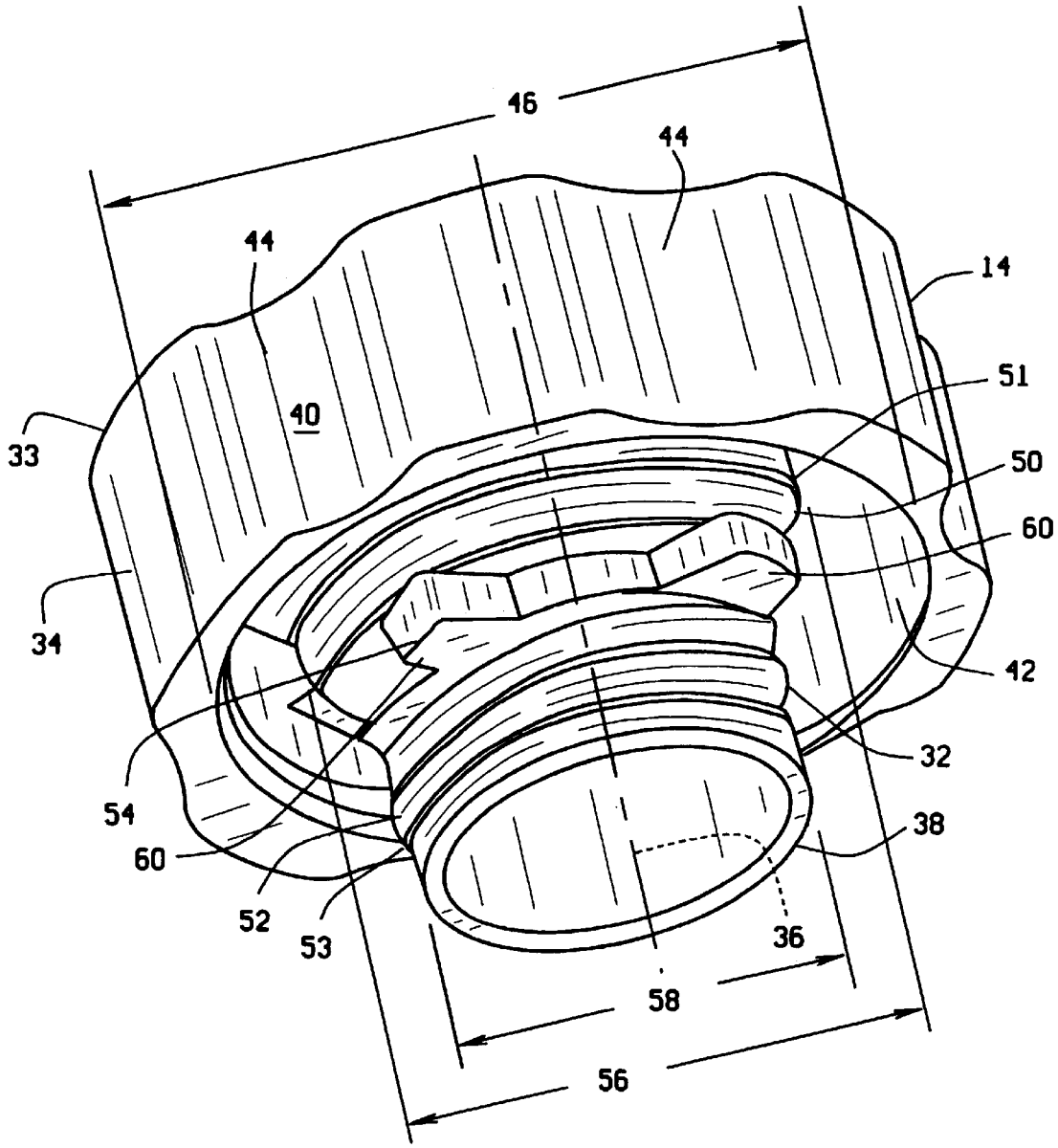
FIG. 2 is perspective view of a radiator cap used with the radiator assembly shown in FIG. 1 including a radiator extension.

FIG. 2 is perspective view of radiator cap 14 including radiator cap extension 32. Radiator cap 14 is generally cylindrical in shape and includes a solid top (not shown in FIG. 2) positioned at a first end 33 of radiator cap 14, a side wall 34 which extends substantially perpendicularly from the top, and an axis of symmetry 36 which extends from first end 33 to a second end 38 of radiator cap 14. Side wall 34 includes an outer surface 40 and an inner surface 42. Outer surface 40 is generally cylindrical in shape and includes a plurality of indentations 44 which extend from outer surface 40 inward towards axis of symmetry 36. Indentations 44 provide a user with handhold surfaces for use when rotating radiator cap 14 during installation or removal of radiator cap 14 from radiator 12 (shown in FIG. 1).

Radiator cap inner surface 42 is circular in shape and includes a diameter 46 sized to fit over neck opening 26 (shown in FIG. 1) and a plurality of threads (not shown in FIG. 2) which engage a plurality of threads (not shown in FIG. 2) disposed on radiator neck 24 (shown in FIG. 1).

Radiator cap extension 32 extends from the radiator cap top and includes a first "O" ring 50 disposed in a first groove 51, a second "0" ring 52 disposed in a second groove 53, and a shoulder assembly 54. First "O" ring 50 is located between the radiator cap top and shoulder assembly 54. Second "O" ring 52 is located between shoulder assembly 54 and second end 38 of radiator cap 14. First "O" ring 50 has a diameter 56 and second "O" ring 52 has a diameter 58 smaller than diameter 56. Additionally, both "O" ring diameters 56 and 58 are smaller than radiator cap inner surface diameter 46 and are smaller than an outer diameter (not shown in FIG. 2) of neck opening 26. Shoulder assembly 54 is formed by a plurality of projections 60 which extend radially outward from radiator cap extension 32 away from axis of symmetry 36.

When radiator cap 14 is installed over radiator neck 24, radiator cap extension 32 is received within radiator neck 24 while the radiator cap threads engage the radiator neck threads. After radiator cap 14 is rotated fully closed, first "O" ring 50 is received in a first mating portion (not shown) of radiator neck 24, second "O" ring 52 is received in a second mating portion (not shown) of radiator neck 24, and shoulder assembly 54 contacts a shoulder (not shown in FIG. 2) of radiator neck 24. Second "O" ring diameter 58 is sized to contact the second mating portion, which has a diameter (not shown) smaller than a diameter (not shown) of the first mating surface, and form a seal between the second mating portion and second "O" ring 52. First "O" ring diameter 56 is sized to contact the first mating portion and form a seal between the first mating portion and first "O" ring 50.

When radiator cap 14 is rotated to a fully closed position (not shown in FIG. 2), radiator cap extension will be positioned such that radiator neck second opening 30 is located between first "O" ring 50 and second "O" ring 52. As cap 14 is rotated away from the fully closed position, when the radiator coolant fluid is pressurized, the pressure will force radiator cap 14 to move axially away from radiator 14, as described in more detail below. As radiator cap 14 is unseated and moved axially from radiator 12, second "O" ring 52 is sized to unseat from the neck second mating portion while first "O" ring 50 remains in contact with the neck first mating portion. Once second "O" ring 52 is unseated, the pressure will vent from radiator 14 past second "O" ring 52 between projections 60 through neck second opening 30 to the recovery tank while radiator cap 14 remains rotated to the fully closed position on radiator neck 24 and sealed to radiator 12.

Figure 3:
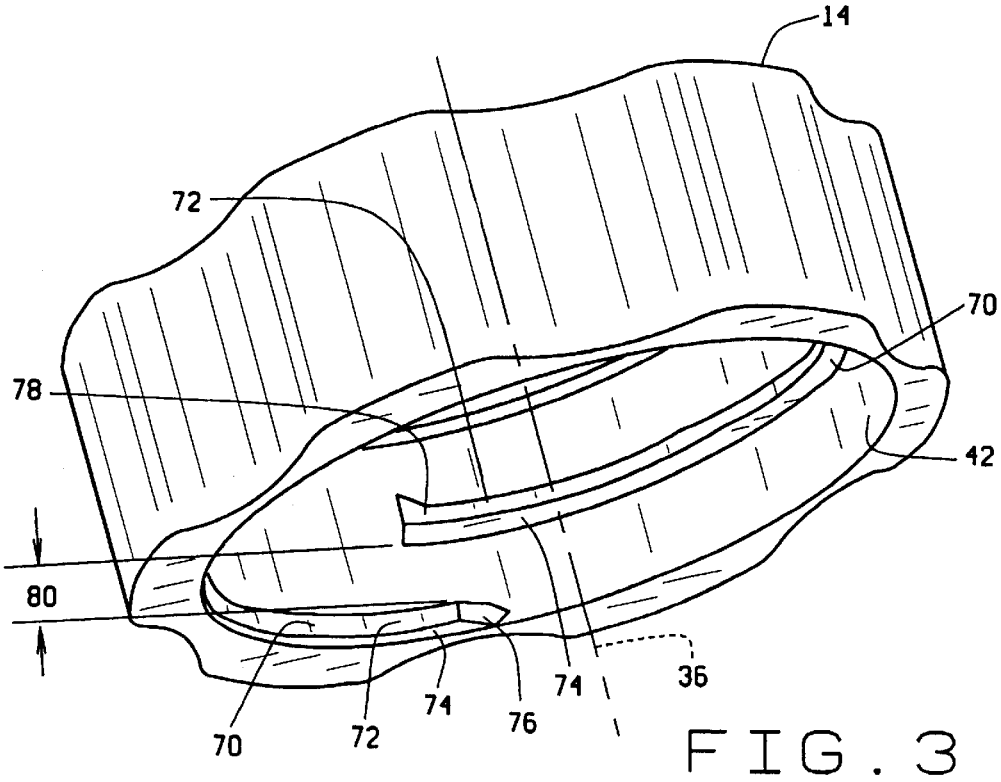
FIG. 3 is a partial perspective view of the radiator cap shown in FIG. 2 without the radiator extension installed.

FIG. 3 is a partial perspective view of radiator cap 14 without radiator cap extension 32 installed. Radiator cap inner surface 42 includes a plurality of threads 70 which extend inward from inner surface 42 towards axis of symmetry 36. Each radiator cap thread 70 has an upper surface 72 which faces the radiator top (not shown in FIG. 3) and a lower surface 74 which faces radiator second end 38 (shown in FIG. 2). Radiator cap threads 70 engage radiator neck threads (not shown in FIG. 3) which permit radiator cap 14 to rotate to the fully closed position (not shown in FIG. 3). Radiator cap threads 70 are cam-like in design which permits radiator cap 14 to tighten and seal against neck opening 26 (shown in FIG. 1) when cap 14 is rotated on radiator neck 24 (shown in FIG. 1).

Radiator cap threads 70 include a beveled end 76, a thread stop 78, and have a clearance 80 between adjacent threads 70. Beveled end 76 is tapered from a crest (not shown in FIG. 3) of thread 70 to radiator cap inner surface 42 which permits radiator cap thread 70 to be easily received in the radiator neck threads. Radiator cap thread clearance 80 is approximately equal to twice a width (not shown in FIG. 3) of a thread root (not shown in FIG. 3) of the radiator neck threads. Thread stop 78 is angled and extends from thread 70 into clearance 80. Thread stop 78 engages, as described in more detail below, a mating thread stop (not shown in FIG. 3) disposed on the radiator neck threads and prevents radiator cap 14 from rotating when moved axially upward on radiator neck 24, due to internal radiator pressure.

Figure 4:
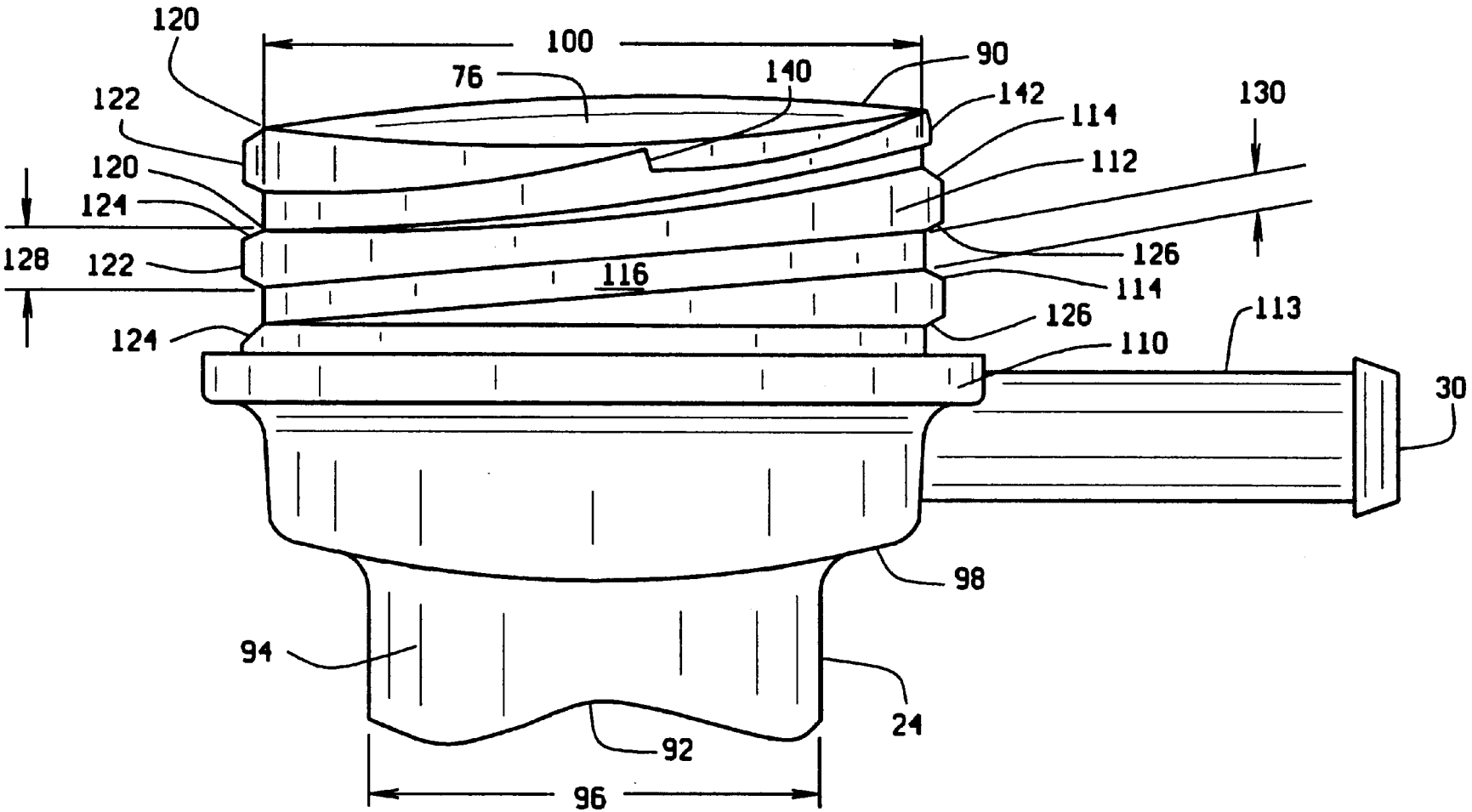
FIG. 4 is side view of a radiator neck used with the radiator assembly shown in FIG. 1.

FIG. 4 is side view of radiator neck 24 used with radiator assembly 10. Radiator neck 24 includes a first end 90 adjacent opening 26 and a second end 92 which extends from radiator body 12 (shown in FIG. 1). Second end 92 has a first body portion 94 having a first diameter 96. First body portion 94 extends from radiator 12 to a shoulder 98 and includes the second mating surface which engages second "O" ring 52 when radiator cap 14 (shown in FIG. 2) is fully installed on radiator 12.

Shoulder 98 has a diameter 100 which is larger than diameter 96 of first body portion 94. Shoulder 98 is sized such that when radiator cap 14 is fully installed on radiator 12, radiator cap shoulder assembly 54 contacts an inner surface (not shown) of shoulder 98 to prevent radiator cap 14 from being over-tightened to neck 24. Shoulder 98 extends from first body portion 94 to a radial projection 110 which extends radially outward from radiator neck 24.

Radiator neck 24 also includes a second body portion 112 and a discharge tube 113. Discharge tube 113 is positioned between radial projection 110 and radiator neck first body portion 94 and extends from shoulder 98 to form opening 30. Radiator neck second body portion 112 extends from radial projection 110 to radiator neck second end 92 and includes a plurality of threads 114 disposed on an outer surface 116 of second body portion 112. Neck threads 114 engage radiator cap threads 70 (shown in FIG. 3).

Each thread 114 includes a root 120, a truncated crest 122 connected to root 120 with an upper surface 124 and a lower surface 126. Each neck thread upper surface 124 faces towards radiator neck first end 90 and each neck thread lower surface faces towards radiator neck second end 92. Neck thread roots 120 each have a width 128 which extends along radiator neck outer surface 116. A clearance 130 between adjacent neck threads 114 is approximately twice the distance of thread root width 128. Clearance 130 is sized to receive radiator cap threads 70 and permit radiator cap 14 to rotate to the fully closed position (not shown in FIG. 4). As described below, radiator cap 14 may move axially upward from radiator 12 until cap 14 is rotated to the fully closed position.

Additionally, neck threads 114 include a thread stop 140 located on a first thread 142 adjacent neck first end 90. Thread stop 140 is angled and extends into clearance 130. After pressure has forced radiator cap 14 axially upward from radiator 12, as described below, radiator cap thread stop 78 contacts neck thread stop 140 and prevents radiator cap 14 from rotating further and being removed from neck 24.

Alternatively, radiator cap 14 is a quick-connect screw cap (not shown) which includes a slot (not shown) which extends through radiator neck threads 114 along outer surface 116.

Figure 5:
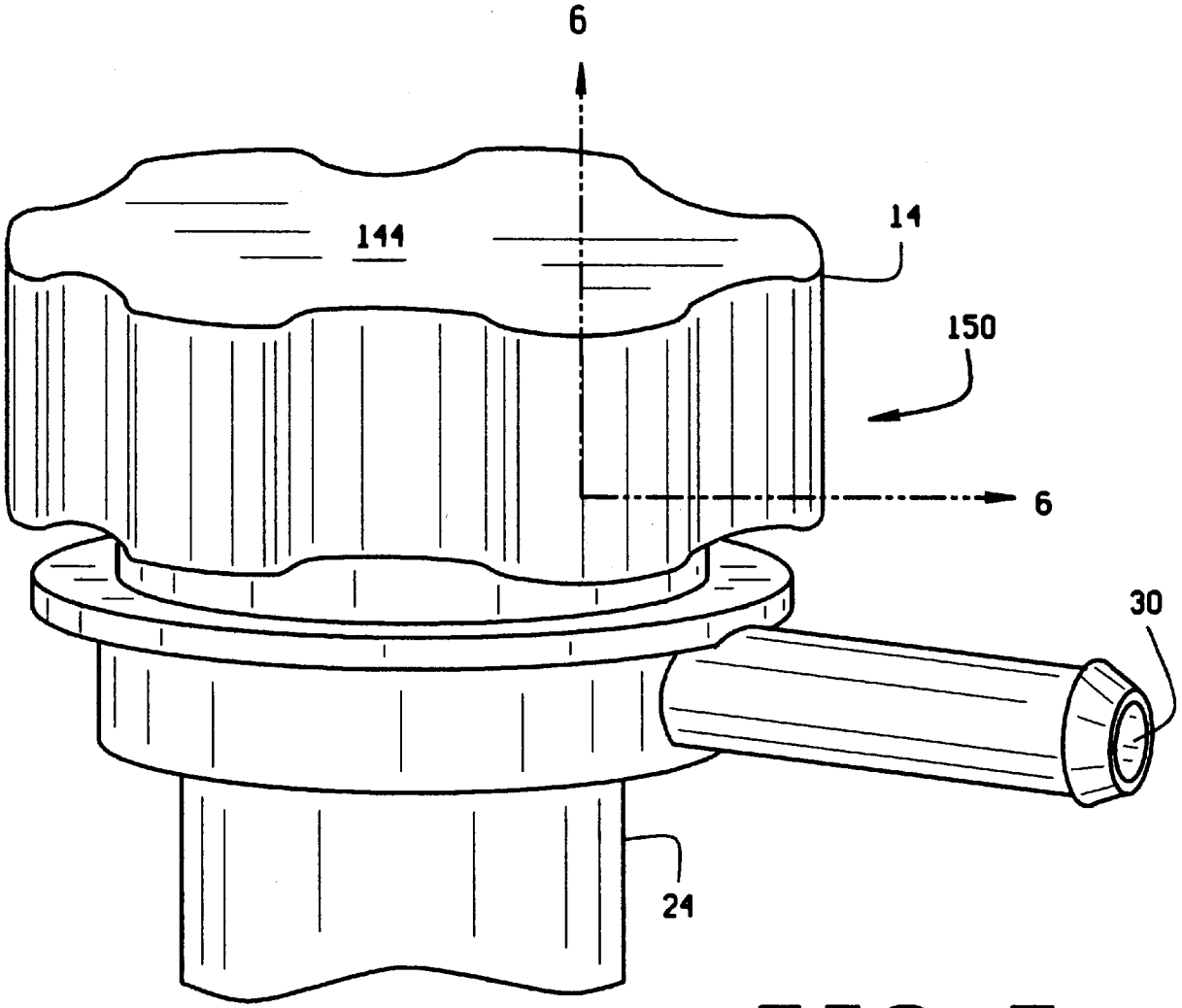
FIG. 5 is a perspective view of a radiator cap fully installed on a neck assembly.

FIG. 5 is a perspective view of radiator cap 14 in a fully closed position 150 on radiator neck 24. Radiator cap 14 includes a top 144 which seals against neck first end 90. Radiator cap threads 70 are right-hand threads which permits radiator cap 14 to rotate clockwise on neck 24 to fully closed position 150. Alternatively, radiator cap threads 70 are left-hand threads which permit radiator cap 14 to rotate counter-clockwise to fully closed position 150.

Figure 6:
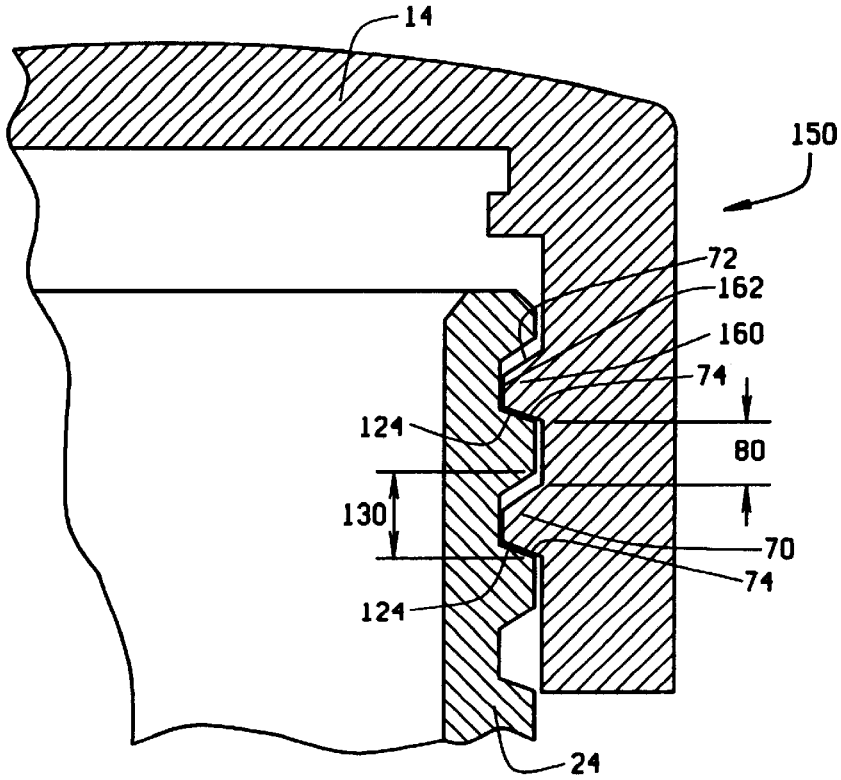
FIG. 6 is a partial cross-sectional view taken along line 6—6 of FIG. 5 showing a radiator cap partially installed on a neck assembly of an un-pressurized radiator.
Figure 7:
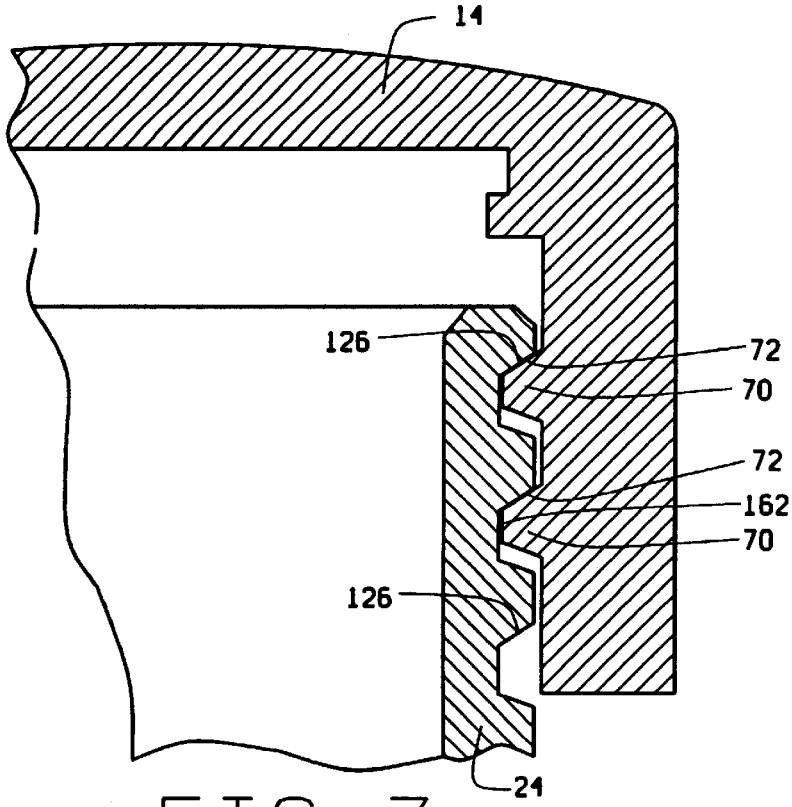
FIG. 7 is a partial cross-sectional view of the radiator cap shown in FIG. 6 partially installed on a neck assembly of a pressurized radiator.

FIG. 6 is a partial cross-sectional view taken along line 6—6 of FIG. 5 illustrating radiator cap 14 partially installed on neck assembly 24 of radiator 12 (shown in FIG. 1) that is not pressurized. FIG. 7 is a similar partial cross-sectional view showing radiator cap 14 partially installed on neck assembly 24 of radiator 12 that is pressurized. Radiator cap threads 70 each include a root 160, and a truncated crest 162 connected to root 160 with upper surface 72 and lower surface 74. When radiator cap 14 is fully installed on radiator neck 24, radiator cap threads 70 engage radiator neck threads 114 such that radiator cap thread upper surfaces 72 remain in contact with radiator neck thread lower surfaces 126. Threads 70 and 114 permit radiator cap 14 to rotate to fully closed position 150 (shown in FIG. 5).

When radiator 14 becomes pressurized and an attempt is made to remove cap 14, the pressure builds against radiator cap 14. The combination of radiator cap thread clearance 80 and radiator neck thread clearance 130 permits radiator cap to move axially upward from radiator 12 such that radiator cap thread upper surfaces 72 contact radiator neck thread lower surfaces 126. Simultaneously, radiator cap thread stop 78 (shown in FIG. 3) contacts radiator neck thread stop 140 (shown in FIG. 4) which prevents radiator cap 14 from rotating and radiator 12 vents pressure to the recovery tank through neck discharge tube 113 and second opening 30.

After radiator 12 finishes venting and the pressure within radiator 12 has decreased, radiator cap 14 can be easily returned to position 150 and thread stops 78 and 140 separate permitting radiator cap 14 to be rotated and removed from neck 24.

While the invention has been described in terms of various specific embodiments, those skilled in the art will recognize that the invention can be practiced with modification within the spirit and scope of the claims.

What is claimed is:

1. A combination comprising:

a radiator having a body portion, heat transfer fins extending from the body portion, an inlet opening and a discharge opening formed in the body portion, and wherein the radiator is constructed and arranged to receive a coolant fluid through the inlet opening, to flow the coolant fluid through the body wherein heat is transferred from the fluid to the body and dissipated to the atmosphere through the fins, and to discharge the fluid from the radiator through the discharge opening;

a neck extending from said body and forming a first opening for filling the body with the coolant fluid, said neck comprising a plurality of threads and a second opening disposed in said neck; and a radiator cap comprising a plurality of threads configured to engage said neck threads, said radiator cap configured to rotate to a fully closed position, said radiator cap threads having a thread stop and said neck threads having a thread stop, said neck threads comprising a clearance which permits said radiator cap to be biased in an axial direction without any rotation when not in said fully closed position and when the fluid held in the radiator body is under pressure and so that the neck thread stop is configured to contact the radiator cap thread stop to prevent the radiator cap from rotating when biased in the axial direction by the fluid under pressure.

2. A combination in accordance with claim 1 wherein each of said neck threads comprises a root and a crest, said root comprising a width, said clearance between adjacent said neck threads approximately twice said neck thread root width.

3. A combination in accordance with claim 2 wherein each of said plurality of radiator cap threads comprises a root, a crest, and a clearance, said clearance sized to receive said neck threads.

4. A combination in accordance with claim 3 wherein said radiator cap clearance between adjacent radiator cap threads is approximately twice said neck thread root width.

5. A combination in accordance with claim 4 wherein said radiator cap thread clearance is approximately equal to said neck thread clearance.

6. A combination in accordance with claim 4 further comprising a radiator fluid in the radiator body.

7. A combination in accordance with claim 6 wherein the fluid is under pressure.

8. A combination in accordance with claim 1 wherein said radiator cap further comprises an extension, said radiator cap threads further comprising a first diameter, said extension comprising a second diameter, said radiator cap threads first diameter greater than said extension second diameter.

9. A combination in accordance with claim 8 wherein said radiator cap extension further comprises a first sealing ring and a second sealing ring, said first sealing ring comprising a first diameter and configured to mate with a first sealing surface disposed on said neck, said second sealing ring comprising a second diameter and configured to mate with a second sealing surface on said neck, said first diameter greater than said second diameter.

* * * * *